US011506205B2

(12) United States Patent
Martens et al.

(10) Patent No.: US 11,506,205 B2
(45) Date of Patent: Nov. 22, 2022

(54) METHOD FOR CONTROLLING A COMPRESSOR TOWARDS AN UNLOADED STATE

(71) Applicant: ATLAS COPCO AIRPOWER, NAAMLOZE VENNOOTSCHAP, Wilrijk (BE)

(72) Inventors: Kristof Adrien Laura Martens, Wilrijk (BE); Stijn Pittois, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 17/421,836

(22) PCT Filed: Jan. 9, 2020

(86) PCT No.: PCT/IB2020/050134
§ 371 (c)(1),
(2) Date: Jul. 9, 2021

(87) PCT Pub. No.: WO2020/157587
PCT Pub. Date: Aug. 6, 2020

(65) Prior Publication Data

US 2022/0074414 A1 Mar. 10, 2022

(30) Foreign Application Priority Data

Jan. 30, 2019 (BE) ..... 2019/5050

(51) Int. Cl.
*F04C 28/26* (2006.01)
*F04C 18/16* (2006.01)

(52) U.S. Cl.
CPC ..... *F04C 28/26* (2013.01); *F04C 18/16* (2013.01); *F04C 2270/205* (2013.01)

(58) Field of Classification Search
CPC ..... F04C 18/16; F04C 28/06; F04C 28/24; F04C 28/26; F04C 29/124; F04C 29/126; F04C 2270/205
See application file for complete search history.

(56) References Cited

U.S. PATENT DOCUMENTS 5,388,968 A 2/1995 Wood et al.
6,739,841 B2 * 5/2004 Nishimura ..... F04C 23/001 417/252

(Continued)

FOREIGN PATENT DOCUMENTS

EP 2027392 A1 2/2009
JP 2017-20516 A 1/2017

(Continued)

OTHER PUBLICATIONS

International Search Report of PCT/IB2020/050134 dated Mar. 16, 2020 [PCT/ISA/210].

(Continued)

*Primary Examiner* — Audrey B. Walter
*Assistant Examiner* — Dapinder Singh
(74) *Attorney, Agent, or Firm* — Sughrue Mion, PLLC

(57) ABSTRACT

A method for controlling a compressor towards an unloaded state, in which the compressor includes a compressor element (2) with an inlet (5), in which in the unloaded state, a residual flow (QD) is suctioned via the inlet (5) towards and into the compressor element (2), and in which for a transition from a loaded state of the compressor to the unloaded state, the inlet (5) of the compressor element (2) is partially closed in successive discrete transitional steps.

29 Claims, 9 Drawing Sheets

(56) References Cited

U.S. PATENT DOCUMENTS

| | | | | |
|---|---|---|---|---|
| 7,607,899 | B2 * | 10/2009 | Van Praag | F04C 28/06 417/440 |
| 7,988,435 | B2 * | 8/2011 | Fujimoto | F04C 28/06 418/9 |
| 9,057,374 | B2 * | 6/2015 | Fujimoto | F04C 29/04 |
| 2011/0014077 | A1 * | 1/2011 | Martens | F04C 29/042 418/84 |
| 2018/0223847 | A1 | 8/2018 | Fujiwara | |

FOREIGN PATENT DOCUMENTS

| | | | |
|---|---|---|---|
| TW | 201420886 | A | 6/2014 |
| TW | 201529985 | A | 8/2015 |
| TW | 201623801 | A | 7/2016 |
| TW | 201719022 | A | 6/2017 |
| WO | 2007/140550 | A1 | 12/2007 |
| WO | 2015/035478 | A1 | 3/2015 |

OTHER PUBLICATIONS

Written Opinion of PCT/IB2020/050134 dated Mar. 16, 2020 [PCT/ISA/237].

* cited by examiner

METHOD FOR CONTROLLING A COMPRESSOR TOWARDS AN UNLOADED STATE

CROSS REFERENCE TO RELATED APPLICATIONS

This application is a National Stage of International Application No. PCT/IB2020/050134, filed Jan. 9, 2020, claiming priority to Belgian Patent Application No. 2019/5050, filed Jan. 30, 2019.

The present invention relates to a compressor, and specifically to a method for controlling such a compressor during a transition from a loaded state, in which the compressor must provide compressed gas to a consumer network, for instance pressurized air, towards an unloaded state, in which no compressed gas is consumed.

The invention relates more specifically to a method for controlling a compressor towards an unloaded state, which compressor comprises a compressor element featuring an inlet and an inlet valve, in which in the unloaded state, a residual flow is suctioned via the inlet towards and into the compressor element and vented via a blow-off valve to an outlet of the compressor, and in which for a transition from a loaded state of the compressor to the unloaded state, the inlet of the compressor element is partially closed in successive discrete transitional steps.

In the unloaded state, the compressor element is not halted, and it continues to be driven at a certain rotational speed. Due to the fact that in that case, apart from some calibrated passage in the inlet valve, the inlet is closed, only a limited amount of gas is suctioned with the residual flow, and no pressure can build up in a pressure tank of the compressor, since the suctioned gas is immediately vented from the outlet into the atmosphere.

Thus, only a minimum of energy is needed to keep the compressor element running in the unloaded state.

After a transition period, a state of equilibrium is reached, in which a certain equilibrium pressure is reached in the pressure tank. The "unloaded state" refers to this state of equilibrium.

The aforementioned calibrated passages are calculated to keep the reached equilibrium pressure in the unloaded state as low as possible for purposes of a low energy use, yet high enough to guarantee, for instance, a sufficient fluid injection via a fluid circuit from the pressure tank to the compressor element in the compressor element of fluid removed from the compressed gas that is needed, among other things, for sufficient cooling and lubrication of the compressor element.

A transition from the unloaded to the loaded state is initiated when an operating pressure in the consumer network falls below a minimum value chosen and set by a user.

In most conventional compressors, the inlet valve is immediately opened entirely as soon as the operating pressure reaches the aforementioned set value, and simultaneously the blow-off valve is entirely closed.

This may cause sudden undesirable temperature peaks in the outlet of the compressor element, which may lead to compressor failure.

A solution for this was described in WO15035478, in which the inlet valve is not immediately opened, but opened only after a certain delay during the transition from the unloaded to the loaded state. This international patent application WO15035478 is then therefore considered to be incorporated by reference in the present description, in the sense that a solution in this international patent application can be combined with the present invention.

A problem that was not yet resolved, however, is a problem that occurs during the opposite transition from the loaded to the unloaded state, which is where the present invention comes in.

In this transition from the loaded to the unloaded state, in conventional compressors, as soon as the desired operating pressure in the consumer network is reached, the inlet valve is suddenly closed, and simultaneously the blow-off valve is opened. At that moment, a pressure at the outlet of the compressor element is at a maximum, and approximately equal to the set operating pressure (except for the pressure drop between the outlet of the compressor element and an outlet of the compressor), and the pressure at the inlet of the compressor element is at a minimum and equal to a negative pressure that is caused because the compressor element continues to suction a small gas flow via aforementioned calibrated openings in the inlet valve.

This means that at the time of the transition from the loaded to the unloaded state, when the inlet valve is suddenly closed and the blow-off valve is opened, the value of the pressure ratio over the compressor element, in other words: the value of the pressure ratio between the pressure at the outlet and the pressure at the inlet of the compressor element, reaches a peak.

This may lead to high vibration levels that can be attributed to periodic pulses of pressure, generated by the compression of the gas at the outlet of the compressor element and which, directly or via an elastic coupling, are conducted to rotating parts of the compressor element and a drive and possibly of a gear enclosure between the drive and the compressor element, in particular when the frequency of the vibrations coincides with the own frequency of the rotating parts or of a structure of the compressor. This negative effect is typically even more pronounced when the aforementioned pressure ratio over the compressor element is higher and might lead to undesirable damage.

The risk of undesirable damage is even larger when there is no elastic coupling between the drive and the compressor element. This is the case, for instance, when the elastic coupling is omitted in order to limit the length of the compressor, in order to save costs, or for easier maintenance.

The task of the present invention is to offer a solution to one or more of the aforementioned and/or other disadvantages, and more specifically, for the problems relating to the transition from the loaded to the unloaded state.

For these purposes, the invention relates to a method for controlling a compressor towards an unloaded state, in which the compressor comprises a compressor element, which compressor element is equipped with:

- an inlet) and a controllable inlet valve with a valve inlet, in which the inlet valve is configured to be able to at least partially close the inlet of the compressor element; and
- an outlet with thereto connected a pressure line which is connected with a downstream consumer network, in which the compressor further comprises a controllable blow-off valve that is connected to the pressure line, in which in a loaded state of the compressor, the blow-off valve is closed and the inlet valve is entirely open, and in which for a transition from the loaded state towards the unloaded state, the method provides for the following steps:
- determining the operating pressure in the consumer network;
- when this operating pressure reaches a set maximum operating pressure, opening the blow-off valve and the partial closing of the inlet of the compressor element by the inlet valve, such that after a transition period from the loaded state to the unloaded state of the compressor, a residual flow is suctioned in the unloaded state towards and into the compressor element via the inlet, characterized in that the partial closing of the inlet during the transition period is performed in successive discrete transitional steps.

One advantage of the method according to the invention is that by the partial closing of the inlet during the transition period, in a number of successive discrete transitional steps, and consequently the suctioning of a flow greater than the residual flow during the transition period, a lower negative pressure is realized via the inlet of the compressor element, or therefore, a greater absolute pressure in the inlet as compared with a situation in which during the transition period only a residual flow would be suctioned towards and into the compressor element immediately via the inlet.

With the transition from the loaded to the unloaded state, the pressure in the outlet of the compressor element is approximately equal to the set maximum operating pressure in the consumer network, since this transition is initiated when this set maximum operating pressure is reached. At that same time, as a result of the invention, the absolute pressure in the inlet is increased, as a result of which a peak of the pressure ratio between the pressure in the outlet and the pressure in the inlet at that moment is decreased, the advantageous result being that hazardous vibration levels resulting from excessively high peaks of the aforementioned pressure ratio can be prevented.

Due to the greater suctioned flow as compared to the residual flow that is suctioned in a normal unloaded state, an equilibrium pressure in a pressure tank connected to the pressure line will be higher than the normal equilibrium pressure in the unloaded state, and it is therefore necessary to reduce the suctioned flow in one or more transitional steps back to the normal unloaded residual flow in order to restore the equilibrium pressure in the pressure tank to its normal equilibrium value in the unloaded state for the purpose of needing as little as possible energy for the unloaded driving of the compressor element.

In order to determine the time of a subsequent transitional step, the method may also include the following steps:

determining a pressure in the pressure tank;

for each transitional step, presetting an initialization pressure for the subsequent transitional step;

performing the subsequent transitional step when during the transition period, the pressure in the pressure tank as equal to or smaller than the preset initialization pressure of the subsequent transitional step.

The preset initialization pressure may be chosen in advance such that immediately after performing the subsequent transitional step, a realized pressure ratio over the compressor element is smaller than a preset maximum pressure ratio.

In the alternative, a simplified method may be used in order to determine an aforementioned time of a subsequent transitional step, which method provides that:

for each transitional step, a time interval is preset to the subsequent transitional step;

a subsequent transitional step is initialized after the end of the aforementioned time interval.

According to a preferred embodiment of the method according to the invention, an extra gas flow suctioned in the compressor element is determined in a first transitional step by a pressure that is needed in the inlet of the compressor element in order to obtain a realized pressure ratio immediately after performing the first transitional step that is smaller than the preset maximum pressure ratio, and this for a pressure at the outlet that is equal to the set maximum operating pressure of the consumer network.

This additional gas that was suctioned into the compressor element may preferably be determined in advance, theoretically or experimentally, as a function of a set maximum operating pressure in the consumer network.

The extra gas flow suctioned in the compressor element in the first step will then be variable, and it is the gas flow that had been determined in advance for the set maximum operating pressure at the time of the transition from the loaded to the unloaded state. For low values of the set maximum operating pressure in the consumer network, the extra suctioned flow may be zero.

The extra gas flow suctioned in the first transitional step will then be variable, and it is the gas flow that had been determined in advance for the set maximum operating pressure at the time of the transition from the loaded to the unloaded state.

In the alternative, the extra gas flow suctioned in the first step may have a fixed value that was determined in advance, theoretically or experimentally, as a function of a safe maximum value of the operating pressure in the consumer network that must be set, which makes the controlling easier.

Preferably, the method is limited to two successive discrete steps for transitioning from loaded to unloaded.

The invention also relates to a compressor comprising a compressor element, which compressor element is equipped with:

an inlet and a controllable inlet valve with a valve inlet, in which the inlet valve is configured to be able to close the inlet, except for one or more calibrated openings; and an outlet with thereto connected a pressure line which is connected with a downstream consumer network, in which the compressor further comprises a controllable blow-off valve that is connected to the pressure line, in which the compressor further comprises a controller for controlling the inlet valve and the blow-off valve during a transition from a so-called loaded state of the compressor to a so-called unloaded state, when the operating pressure in the consumer network reaches a set maximum operating pressure, in which in the loaded state, the inlet valve is entirely open and the blow-off valve is closed, and in the unloaded state, the blow-off valve is open and the inlet of the compressor element is partially closed by the inlet valve, such that after a transition period from the loaded state to the unloaded state of the compressor, a residual flow is suctioned in the unloaded state towards and into the compressor element via the inlet, characterized in that the compressor is equipped with means to use the controller to partially close the inlet of the compressor element during the transition period in successive discrete transitional steps.

It goes without saying that such a compressor according to the invention has the same benefits as the previously described method according to the invention.

With the understanding [sic] to better demonstrate the features of the invention, in the following, without these descriptions having any restrictive character, some examples of preferred applications are described of a compressor and of a method according to the invention for controlling such a compressor for the transition from the loaded to the unloaded state, with reference to the enclosed drawings, in which.

Figure 1:
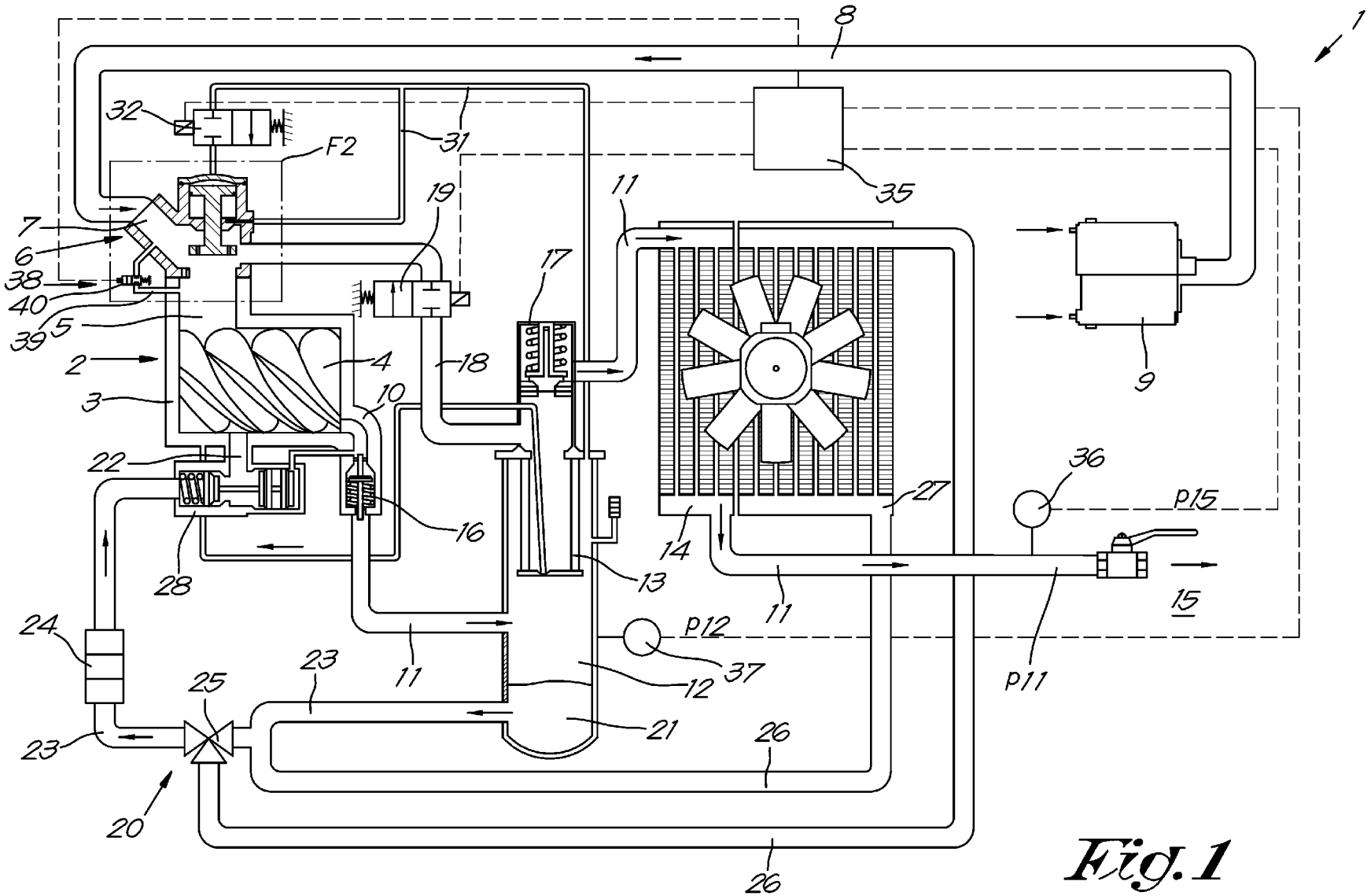
FIG. 1 is a schematic representation of a compressor according to the invention in its loaded state.

The installation shown in FIG. 1 relates to a compressor according to the invention, in this case, a fluid-injected screw compressor 1, which compressor comprises a compressor element 2 of a conventional screw type with an enclosure 3 in which two cooperating helical rotors 4 are driven by means of a motor or something similar, not shown in the figure.

The compressor element 2 features an inlet 5 that is sealable by means of a controllable inlet valve 6 with a valve inlet 7, connected by means of an suction line 8 with an inlet filter 9 in order to suction a gas, in this case, air, from the environment.

The compressor element 2 is also equipped with an outlet 10 with thereto connected a pressure line 11, which is connected via a pressure tank 12 containing a fluid separator 13 and via a cooler with a consumer network 15 downstream for feeding various pneumatic tools or something similar, not shown here.

In this case, a check valve 16 is provided at the outlet 10 of the compressor element 2, and a minimum pressure valve 17 is arranged on the outlet of the pressure tank 12.

In the pressure tank 12, an exhaust branch 18 is provided, which culminates at the location of the valve inlet 7 of the inlet valve 6, and which is sealable by means of a blow-off valve 19 in the form of a controllable electric valve.

The screw compressor 1 is equipped with a fluid circuit 20 in order to inject a fluid 21, for instance oil, under the influence of a pressure $p_{12}$ in the pressure tank 12 from this pressure tank 12 into the compressor element 2 in order to lubricate and/or cool and/or for providing a seal between the various rotors 4 mutually and between the rotors 4 and the enclosure 3.

This fluid circuit 20 comprises an injector 22 or something similar that is connected via an injection line 23 containing a fluid filter 24 with the pressurized fluid 21 in the pressure tank 12.

The fluid 21 flowing from the pressure tank 12 to the injector 22 may be diverted via a thermostatic faucet 25 via a branch line 26 through a fluid cooler 27 in order to regulate a temperature in the injection line 23.

In the example shown in the figures, a controlled shut-off valve 28 is provided on the injector 22, which prevents fluid from flowing back from the compressor element 2 to the pressure tank 12, and from flowing from the pressure tank 12 to the compressor element 2 while this compressor element 2 is at rest.

Alternatively, the functions of the check valve 16 and of the shut-off valve 28 may also be incorporated in the operations of the inlet valve 6, in which case no physical check valve 16 and no physical shut-off valve 28 have to be provided.

Figure 2:
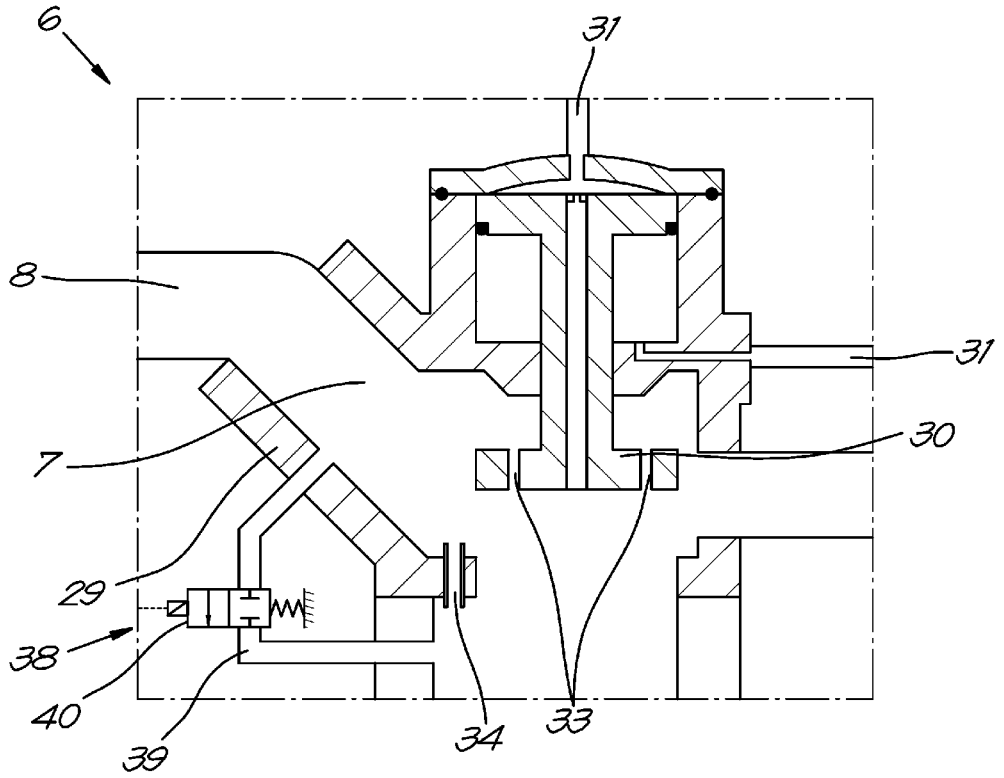
FIG. 2 shows the part of FIG. 1 that is marked in it by the frame F2.
Figure 4:
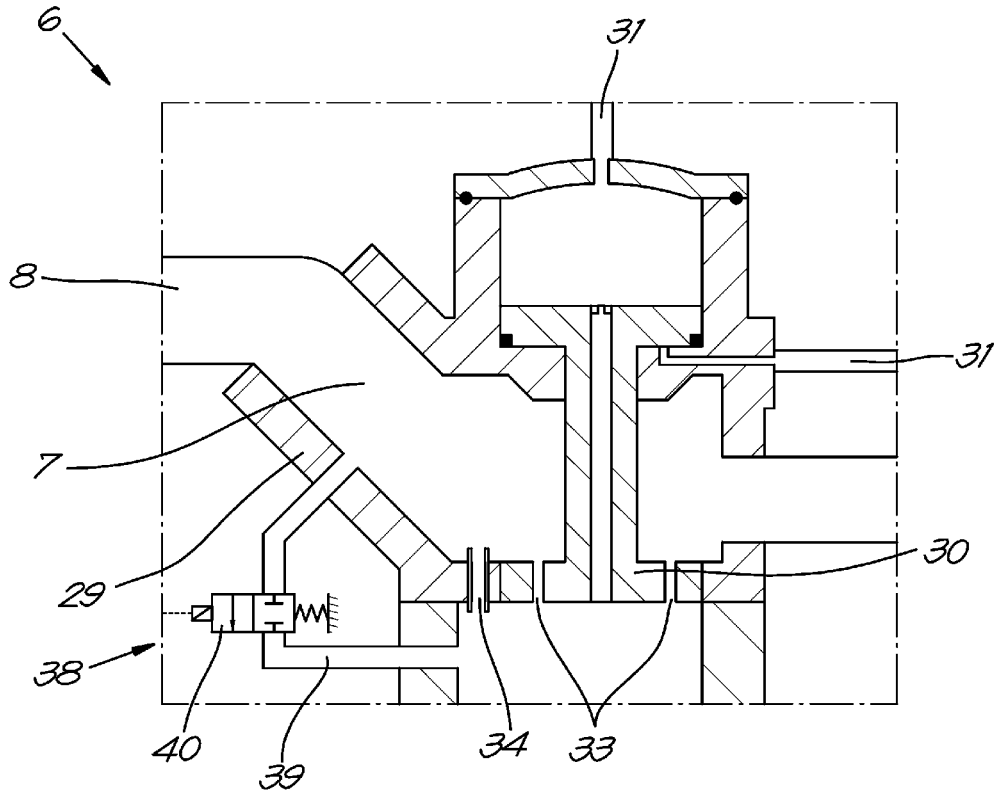

The inlet valve 6 is shown in more detail in FIG. 2, and comprises an enclosure 29, in which a poppet valve 30 is movably arranged between a position as shown in FIG. 1, corresponds with a loaded state, in which the inlet 5 of the compressor element 2 is set to be open to a maximum, and a position corresponds with the unloaded state, in which the inlet 5 is closed to a maximum as shown in FIG. 4, with the exception of some calibrated passage 33 and 34 for letting through a residual flow $Q_D$.

The opening and closing of the inlet valve 6 is done in this case in a conventional manner under the influence of a pilot pressure that is branched off via a control line 31 from a lid of the pressure tank 12, for instance, and is let through by means of a control valve 32 or something similar in order to close the inlet valve 6, or which is closed in order to open the inlet valve 6.

In the poppet valve 30 itself and in the enclosure 29 of the inlet valve 6, the aforementioned calibrated passages are provided, respective 33 and 34, which provide for a permanent connection between the valve inlet 7 of the inlet valve 6 and the inlet 5 of the compressor element 2 in order to be able to suction a residual flow $Q_D$ in a controlled manner when the inlet valve 6 is closed, as in the unloaded state of FIG. 4.

In addition, an electrical or electronic controller 35 is provided in order to regulate an operating pressure $p_{15}$ in the consumer network 15 within an pressure interval that is delimited by a minimum operating pressure $p_{15\ min}$ and a maximum operating pressure $p_{15\ max}$ which may be selected by the user of the screw compressor 1 and can be chosen and entered in the controller 35, and which is connected for that purpose with a pressure sensor 36 for measuring or determining the operating pressure $p_{15}$ in the consumer network 15.

The controller 35 is furthermore equipped with a program or something similar in order to control the inlet valve 6 via the control valve 32 and the blow-off valve 19, such that when the operating pressure $p_{15}$ in the consumer network 15 drops below the minimum operating pressure $p_{15\ min}$ due to a decrease of air, the screw compressor 1 enters into a loaded state, in which the inlet valve 6 is open and the blow-off valve 19 is closed, as shown in FIGS. 1 and 2, until no further compressed air or gas can be removed, is extracted, this causing the pressure $p_{15}$ in the consumer network 15 to rise.

Figure 3:
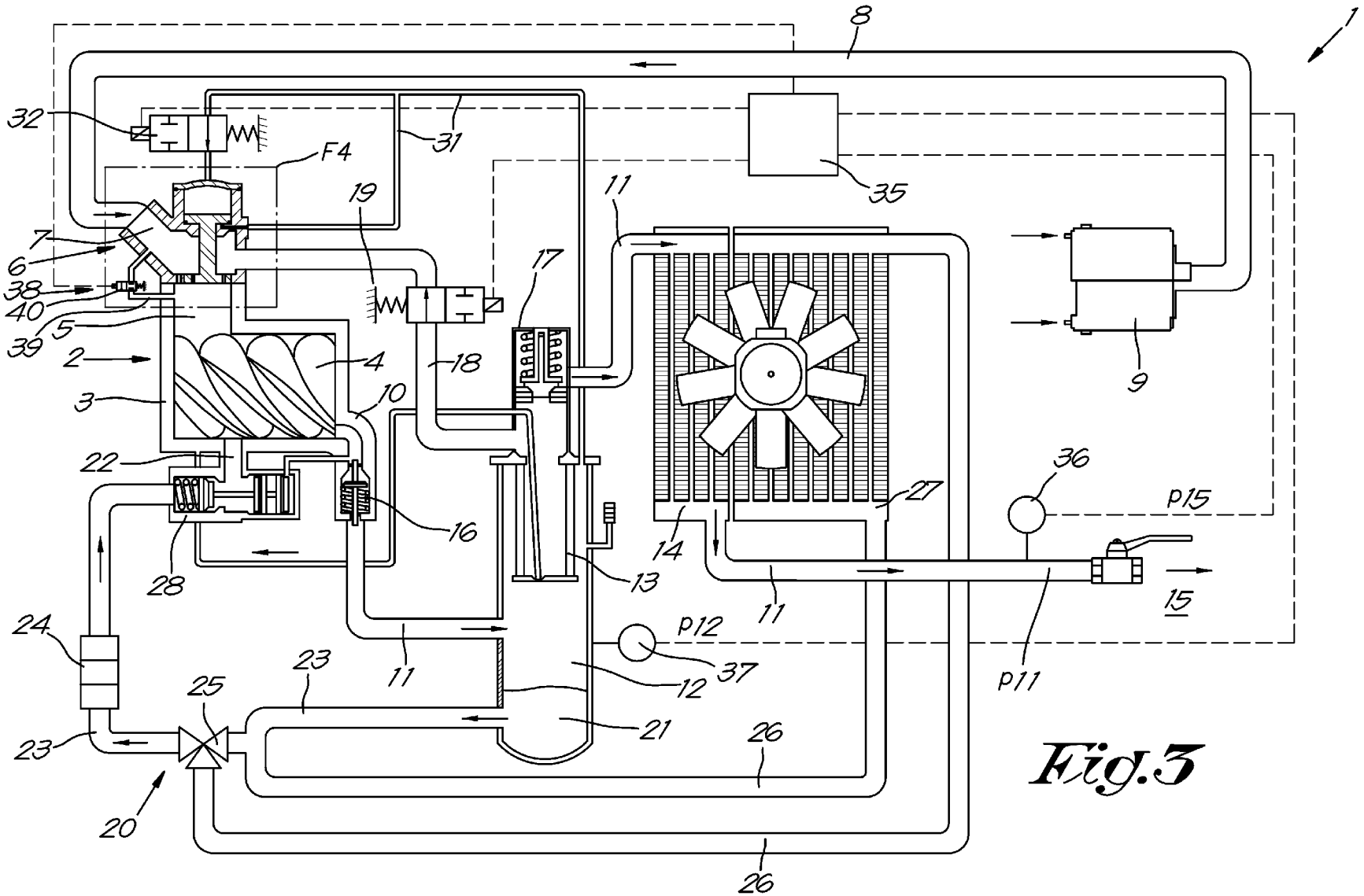
FIGS. 3 and 4 are corresponding figures, but show the compressor in its unloaded state.

As of the moment that the pressure $p_{15}$ reaches the maximum operating pressure $p_{15\ max}$, the controller switched from the loaded state to an unloaded state, in which the inlet valve 6 is closed is and the blow-off valve 19 is opened, as shown in FIGS. 3 and 4.

As a result, no gas is suctioned by the compressor element 2, which is still being powered, except for a residual flow $Q_D$, which is suctioned and compressed via the calibrated passages 33 and 34.

As a result, after a transition period, an equilibrium with a constant minimum equilibrium pressure pia, is generated in the pressure tank 12, the value of which is dependent on the chosen calibrated passages 33 and 34, which are preferably chosen such that in the unloaded state, this minimum equilibrium pressure pia, is as low as possible in order to limit the energy required for driving the compressor element 2 in the unloaded state to a minimum.

This minimum equilibrium pressure pia, is measured, for instance, by way of a pressure sensor 37, of which the signal is linked back to the controller 35.

Specifically, according to the invention, the screw compressor 1 is equipped with means 38 for closing the inlet 5 of the compressor element 2 only partially at when the set operating pressure $p_{15\ max}$ is reached in a first transitional step, using the controller 35, in order to suction an extra flow $\Delta Q$, relative to the residual flow $Q_D$ of the unloaded state of FIGS. 3 and 4, via the inlet 5 towards and into the compressor element 2, thus suctioning a total flow into the compressor element 2 that is larger than the residual flow $Q_D$ that is suctioned via the calibrated passages 33 and 34 in the unloaded state.

In the case of FIGS. 1 to 4, the means 38 are formed by an additional bypass 39 with a calibrated opening for bridging the poppet valve 30 of the inlet valve 6 for suctioning air when the inlet valve 6 is closed, in which in this additional bypass 39, a controllable shutter 40 is provided, in this case, in the form of an electric valve connected with the controller 35.

Figure 5:
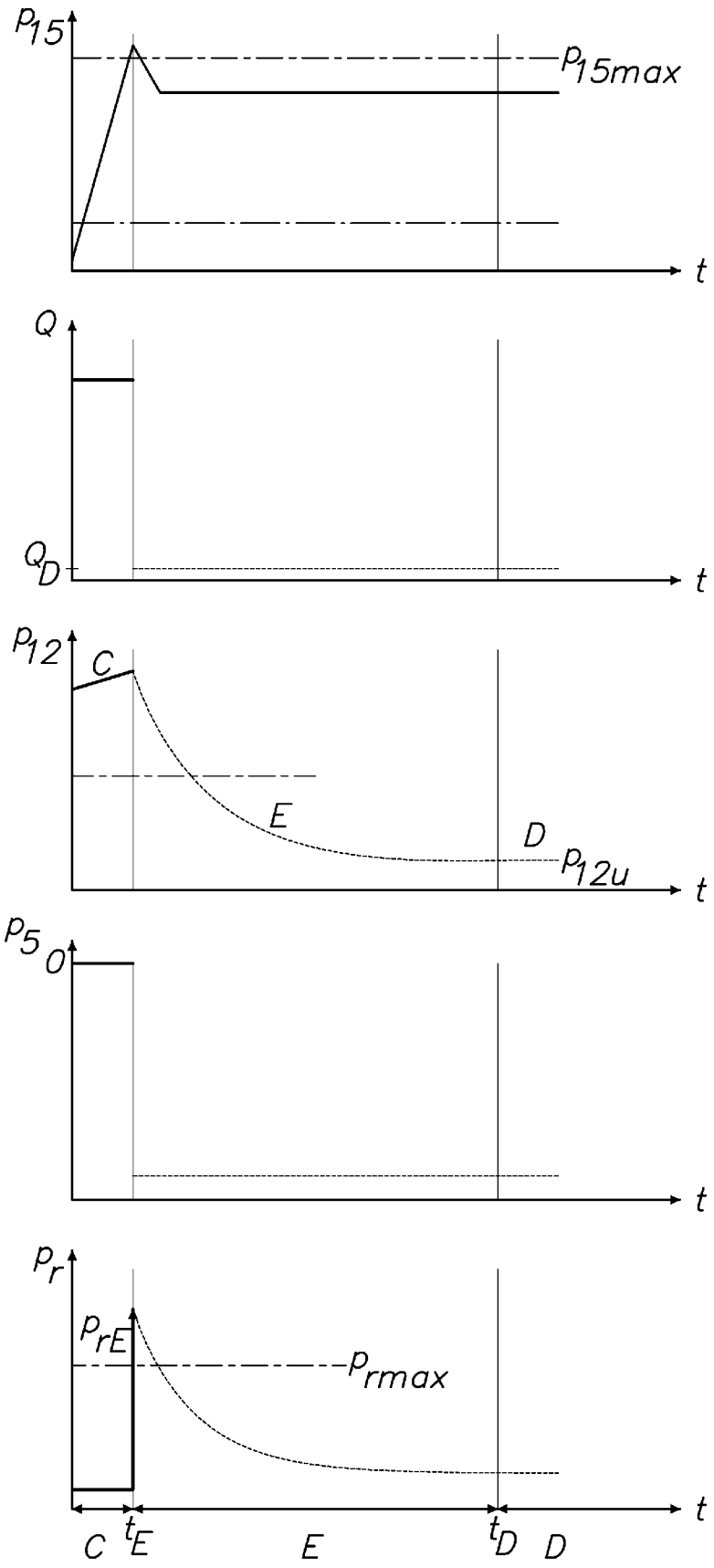
FIG. 5 shows a series of graphs relating to the development over time of some of the operating parameters of the compressor of FIGS. 1 and 2 during the transition from the loaded state of FIG. 1 to the unloaded state of the FIGS. 3 and 4.

This is shown in the graphs of FIG. 5, which show the transition from the loaded to the unloaded state, in which the additional bypass 39 is not opened, for which reason no extra flow is suctioned according to a method traditionally used for the transition from the loaded to the unloaded state and as described, for instance, in WO15035478.

In this FIG. 5, the following graphs are shown, respectively one after the other: the operating pressure $p_{15}$ in the consumer network, the mass flow gas Q suctioned by the compressor element 2, the pressure $p_{12}$ in the pressure tank 12, an (under)pressure $p_5$ in the inlet 5 of the compressor element 2, a pressure ratio $p_r=p_{12}/p_5$ between the two previous absolute pressures $p_{12}$ and $p_5$, all these on the same time scale t.

This FIG. 5 illustrates a loaded state C prior before time $t_E$ and an unloaded state D, which is reached after a transition period E at a time $t_D$ in which a state of equilibrium is reached.

At the aforementioned time $t_E$, the inlet valve 6 is moved from an open position as in FIG. 1 to a closed position as in FIG. 3, and simultaneously, the blow-off valve 19 is opened.

After closing the inlet valve 6, the suctioned flow is limited to the residual flow $Q_D$ that is suctioned via the calibrated passages 33 and 34.

This generates a negative pressure in the inlet 5 of the compressor element 2.

By opening the blow-off valve 19, during the transition period E, gas is vented from the pressure tank 12, as a result of which the pressure $p_{12}$ in the pressure tank 12 decreases gradually from a pressure $p_{12}$ which at the time $t_E$ had been approximately equal to the set maximum pressure $p_{15\ max}$ in the consumer network 15, to the minimum equilibrium pressure pia, of the unloaded state D.

It therefore transpires from the graphs that at the time $t_E$, the pressure $p_{12}$ in the pressure tank is at a maximum, and that therefore a pressure $p_{10}$ in the outlet 10 of the compressor element 2 and at the same time also the pressure $p_5$ in the inlet 5 of the compressor element 2 are at a minimum, as a result of which the resulting pressure ratio $p_r$ reaches a peak $p_{rE}$ at the time $t_E$.

When this peak $p_{rE}$ of the pressure ratio $p_r$ is too high, for instance when it is greater than a maximum pressure ratio $p_{rmax}$ as indicated in FIG. 5, this may pose a problem in terms of undesirable vibrations, as explained in the introduction. A safe value $p_{rmax}$ may be experimentally or theoretically determined, for instance, for a specific screw compressor 1.

The value of the peak $p_{rE}$ may, for instance, be determined or derived from measurements of the pressures $p_{12}$ and $p_5$ or similar related pressures.

To the extent that the peak $p_{rE}$ remains below the maximum pressure ratio $p_{rmax}$, there is no risk of vibrations and no further action needs to be undertaken to lower that peak $p_{rE}$.

Figure 6:
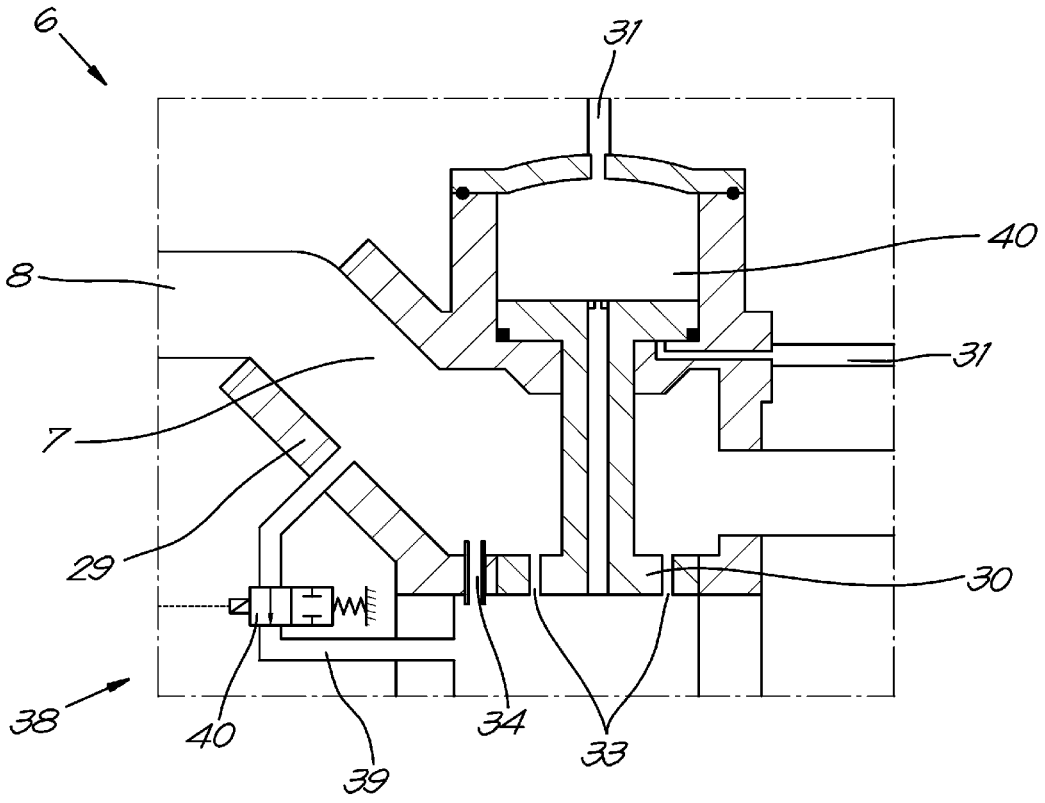
FIG. 6 shows the compressor according to the invention in an intermediary state between the loaded and unloaded states of FIGS. 1 and 3, more specifically after a first transitional step of the method according to the invention.

In the event that the measured peak $p_{rE}$ indeed turns out to be higher than $p_{rmax}$, the method according to the invention provides for an additional first transitional step, in which at time $t_E$, the inlet 5 of the compressor element 2 is opened further, for instance by opening the additional bypass 39 as shown in FIG. 6.

As a result, an extra flow $\Delta Q$ is suctioned by the compressor element 2 via the additional bypass 39 in addition to the residual flow $Q_D$ that is already suctioned via the calibrated passages 33 and 34, as in the unloaded state D, which leads to a resulting flow $Q_{E'}$.

Figure 7:
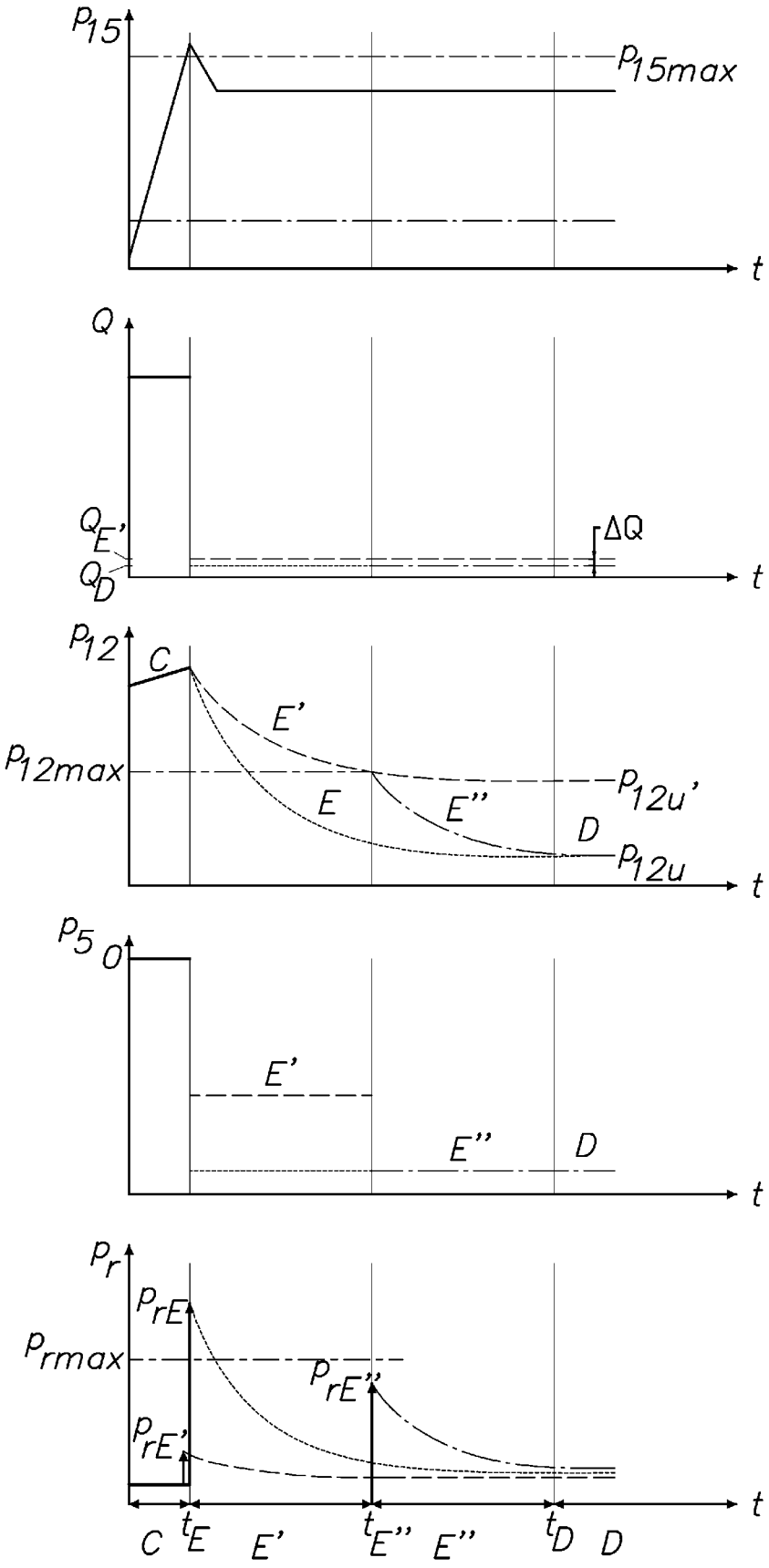
FIG. 7 shows the time span of the operating parameters of FIG. 5, but taking into account the intermediary state of FIG. 6, and superimposed on the graphs of FIG. 5 for comparison purposes.

The effect of this is shown in the graphs of FIG. 7.

Because more compressed gas arrives in the pressure tank 12, the venting of the pressure tank 12 in the transition period E' will cause the pressure $p_{12}$ in the pressure tank 12 to decrease less and to evolve towards an equilibrium pressure $p_{12u'}$, which is higher than the aforementioned minimum equilibrium pressure $p_{12u}$ in FIG. 5 of the unloaded state of the screw compressor 1.

At the same time, in the inlet 5 of the compressor element 2, less of a vacuum will be generated, are the absolute pressure $p_5$ will therefore be greater in the transition period E'.

This results in a reduced peak of the pressure ratio $p_r$, which is now reduced to a value $p_{rE'}$ which, as shown in FIG. 7, is smaller than the peak $p_{rE}$ and lower than the aforementioned maximum pressure ratio $p_{rmax}$.

The value $p_{rE'}$ of the pressure ratio immediately after the first transitional step is equal to the ratio of:

- pressure $p_{12}$ in the pressure tank 12, which at that time $t_E$ is approximately equal to the set operating pressure pis in the consumer network 15, and
- the negative pressure in the inlet 5, which is a function of the amount of extra flow $\Delta Q$, which itself depends on a restriction in the additional bypass 39.

The extra flow $\Delta Q$ needed for restricting the pressure ratio $p_r$ to the maximum pressure ratio pretax is therefore a function of the set maximum operating pressure $p_{rmax}$ and may be determined theoretically or experimentally, for instance, as a function of the set maximum operating pressure $p_{15\ max}$.

The restriction in the additional bypass 39 can then be controllable for instance as a function of the set maximum operating pressure $p_{15\ max}$.

Alternatively, a fixed restriction for the additional bypass 39 may be chosen, which would then be chosen for safety reasons as a function of the highest possible maximum operating pressure $p_{15\ max}$ in the consumer network 15 that can be set.

It is clear that when a low set maximum operating pressure $p_{15\ max}$ does not pose a risk, which means that in the first transitional step, the maximum pressure ratio $p_{rmax}$ is not exceeded without letting through an extra flow $\Delta Q$ in this transitional step, this extra step of opening the additional bypass 39 according to the invention may be omitted.

The higher equilibrium pressure $p_{12u'}$ after the first transitional step requires that the energy required to keep the screw compressor 1 running in this unloaded transition period E' is high.

In an additional second transitional step, the method according to the invention therefore provides for the reduction of the flow to the residual flow $Q_D$ of the unloaded state D by removing the extra flow ΔQ after a first transition period E', for instance by the closing the additional bypass 39 again at a time $t_E$".

After a second transition period E", this leads to a new equilibrium pressure, which is equal to the equilibrium pressure $p_{12u}$ of the unloaded state D.

At time $t_{E''}$, the closing of the additional bypass 39 creates a new peak $p_{rE''}$ of the pressure ratio $p_r$, which again may not be higher than the maximum pressure ratio $p_{rmax}$. If this is not the case, a third transitional step or further transitional steps may be inserted as needed, in which the flow suctioned via the inlet 5 is reduces with each transitional step, for instance by closing the additional bypass 39 or by providing multiple additional bypasses 39, of which in each transitional step, one or more are at least partially closed.

In the case of FIG. 7, two transitional steps are sufficient, effectively splitting the transition period E into two shorter transition period E' and E".

The time $t_{E''}$ of the second transitional step may be determined, for instance, by measuring the pressure $p_{12}$ in the pressure tank 12 or an injection pressure $p_{22}$ at the injector 22 or the pressure $p_{10}$ at the outlet 10 of the compressor element 2, such that the second transitional step is performed at time $t_{E''}$, when this measured pressure has dropped to a preset safe initialization pressure $p_{12\ max}$ or $p_{22\ max}$, as shown in FIG. 7.

At time $t_{E''}$, the closing of the additional bypass 39 causes the pressure $p_5$ in the inlet 5 to drop suddenly, as a result of which the pressure ratio $p_r$ suddenly increases to the new peak $p_{rE''}$.

The preset initialization pressure $p_{12\ max}$ is chosen such that immediately after performing the second transitional step, at time $t_{E''}$, the new peak $p_{rE''}$ is smaller than the aforementioned preset maximum pressure ratio $p_{rmax}$.

If no pressures are measured, alternatively, the time $t_{E''}$ may be determined by means of a timer with a programmed time interval $t_{E''}$-$t_E$ between the first transitional step and the subsequent transitional step. The time interval to be set may be determined experimentally, for instance.

During the transition period from the loaded to the unloaded state, it is preferable for the pressure tank 12 to be vented as soon as possible in order to keep the total resulting transition period E' and E" as short as possible for reasons of energy saving. In this transition period, the pressure $p_{12}$ in the pressure tank 12 is greater than the minimum equilibrium pressure $p_{12u}$, of the unloaded state D.

By keeping this transition period as short as possible, there will only be a small difference between the energy use in the case of the invention with a transition in two transitional steps, as compared to the energy use without the application of the invention and a transition in a single transitional step.

The additional bypass 39 can also be used for applying the invention described in WO15035478 for the transition from the unloaded to the loaded state when the operating pressure $p_{15}$ in the consumer network drops below a set minimum operating pressure $p_{15\ min}$.

In this case, the controller 35 must be provided with an algorithm in order to close the blow-off valve 19 during a transition from the unloaded to the loaded state and to keep the inlet valve 6 closed initially and to open it only after a certain delay, and during this delay, to open the bypass 39 in order to allow the pressure $p_{12}$ in the pressure tank 12 to increase gradually and to open the inlet valve 6 only when the pressure $p_{12}$ in the pressure tank 12 has reached a set minimum threshold value $p_{12\ min}$ which is sufficient for avoiding temperature peaks due to an insufficient fluid injection.

This means that the same device can be used for preventing temperature peaks during the transition from the unloaded to the loaded state and for preventing peaks of the pressure ratio $p_r$ during the transition from the loaded to the unloaded state. This only requires a control adjustment.

Figure 8:
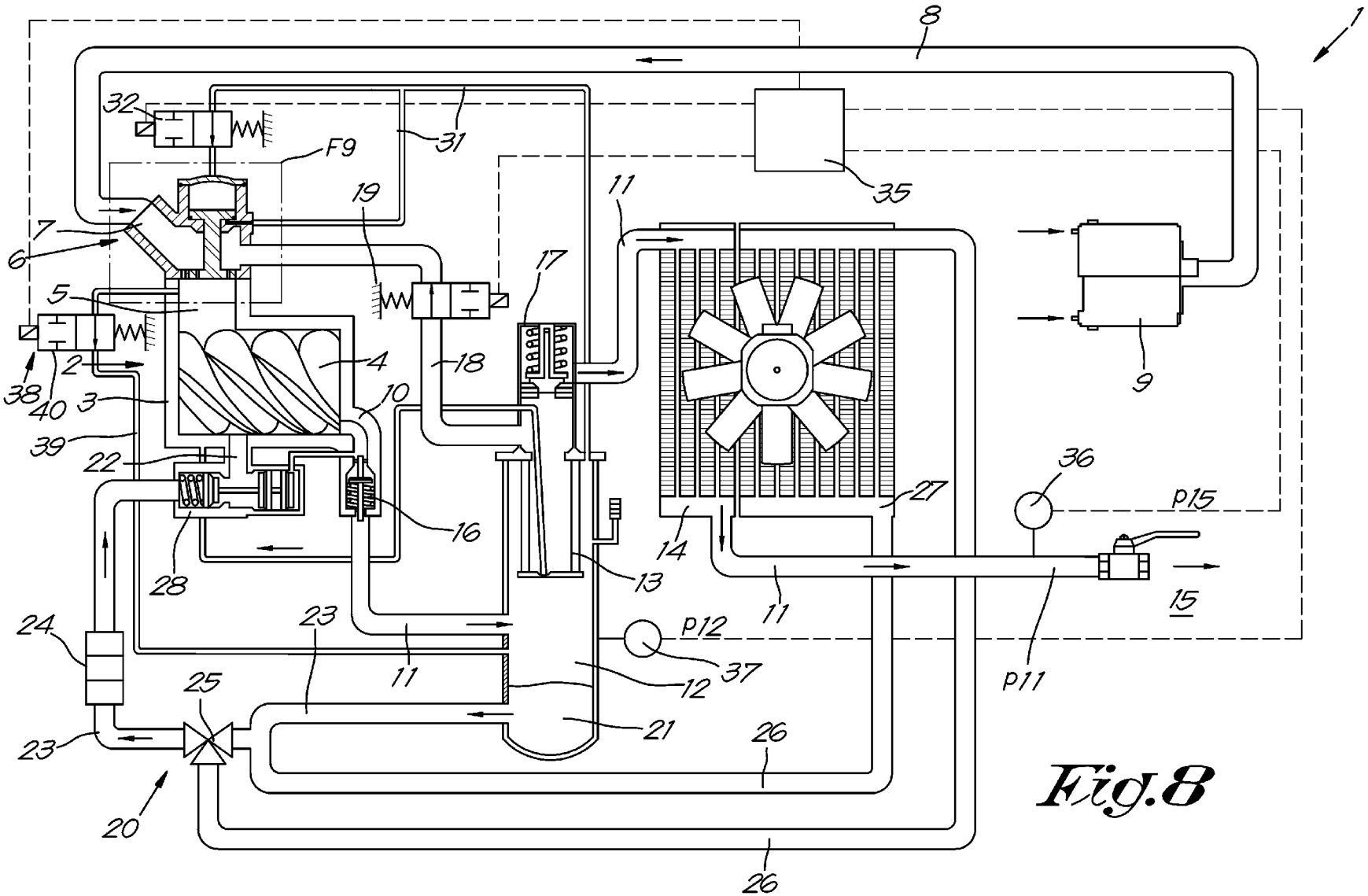
FIGS. 8 and 9 show two other alternative embodiments of a compressor according to the invention.

An alternative embodiment of a screw compressor 1 according to the invention is shown in FIG. 8, which differs from the embodiment of FIGS. 1 and 3 in that the additional bypass 39 in this case connects the inlet 5 of the compressor element 2 with the pressure tank 12, instead of with the inlet 7 of the inlet valve 6.

The controllable shutter 40 in this bypass 39 allows for receiving the extra flow ΔQ, in this case during the transition from the loaded to the unloaded state, from the pressure tank 12.

In this case, the peak $p_{rE}$ of the pressure ratio $p_r$ will be lower than in FIG. 7, but a curve for pressure $p_{12}$ in the pressure tank 12 as a function of the time t swill drop less fast towards the equilibrium pressure $p_{12u'}$.

Figure 9:
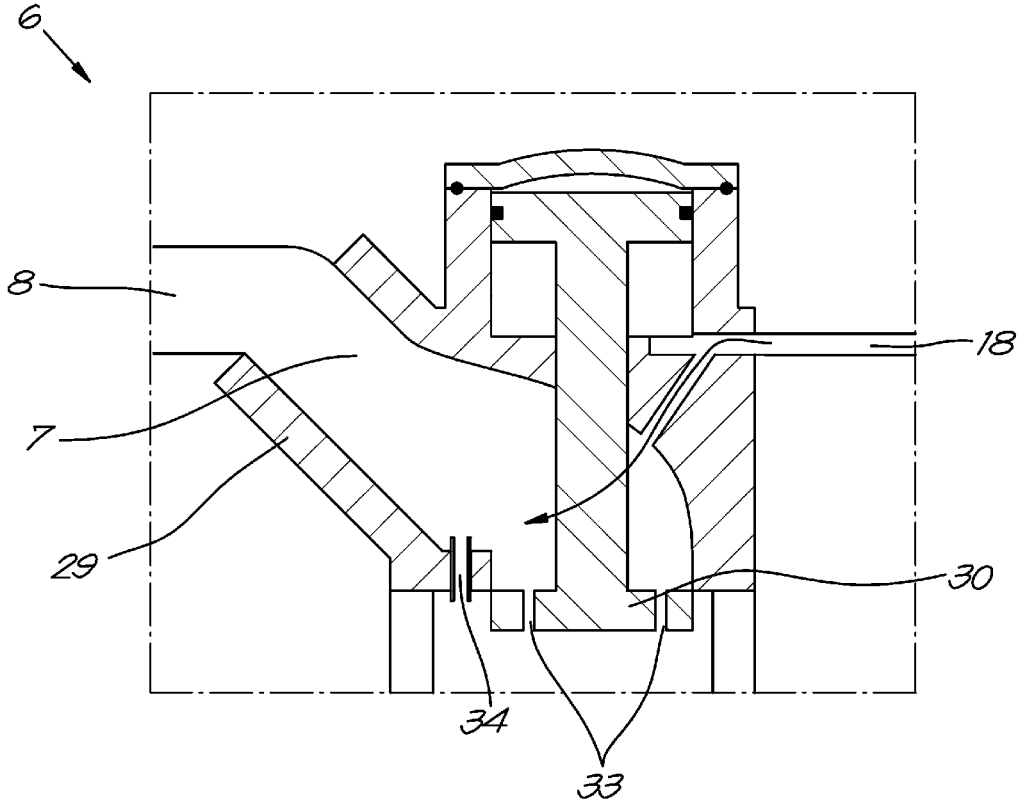

The extra flow ΔQ may also be realized without an additional physical bypass 39, but by not entirely closing the inlet valve 6 during the first transitional step, as shown in FIG. 9, in order to suction the extra flow ΔQ via the inlet 5 in the compressor element 2 during the first transition period E' and to close it entirely only at time $t_{E''}$ of the second transitional step.

It is self-evident that the invention is not limited to inlet valves 6 as shown, but can also be expanded to other valve types such as butterfly valves, or something similar.

It is clear that depending on the type of inlet valve 6 and blow-off valve 19, different means 38 may be used for allowing for an extra flow ΔQ, initially temporarily, during the transition from the loaded to the unloaded state.

Due to the invention, possible vibration peaks are prevented or the vibration image is adjusted, which may allow for the compressor element 2 to be driven by motor via a rigid connection, without an intermediary flexible coupling.

The present invention is in no way limited to the fluid-injected screw compressor and the method according to the invention used therein for controlling the transition from the loaded to the unloaded state, as described in the examples and shown in the figures; rather, it may be implemented in a variety of variants without exceeding the framework of the invention.

The invention claimed is:

1. A method for controlling a compressor towards an unloaded state, in which the compressor comprises a compressor element (2), the compressor element (2) being equipped with:

an inlet (5) and a controllable inlet valve (6) with a valve inlet (7), in which the inlet valve (6) is configured to be able to at least partially close the inlet (5) of the compressor element (2); and an outlet (10) with thereto connected a pressure line (11) which is connected with a downstream consumer network (15), in which the compressor further comprises a controllable blow-off valve (19) that is connected to the pressure line (11), in which in a loaded state of the compressor, the blow-off valve (19) is closed and the inlet valve (6) is entirely open, and in which for a transition from the loaded state towards the unloaded state, the method provides for the following steps:

determining an operating pressure ($p_{15}$) in the consumer network (15); and when this operating pressure ($p_{15}$) reaches a set maximum operating pressure ($p_{15\ max}$), opening the blow-off valve (19) and partially closing the inlet (5) of the compressor element (2) by the inlet valve (6), such that after a transition period from the loaded state of the compressor to the unloaded state, in the unloaded state, a residual flow ($Q_D$) is suctioned via the inlet (5) towards and into the compressor element (2), wherein the partial closing of the inlet (5) during the transition period is performed in successive discrete transitional steps.

2. The method according to claim 1, wherein in a first transitional step, the inlet (5) of the compressor element (2) is partially closed in such a manner that with respect to the aforementioned residual flow ($Q_D$), an extra gas flow ($\Delta_Q$) is let through via the inlet (5), and that in any subsequent transitional step, the inlet (5) is closed further each time in order to suction increasingly smaller flows via the inlet (5) towards and into the compressor element (2).

3. The method according to claim 2, wherein the extra gas flow ($\Delta Q$) in the first transitional step is determined by a pressure ($p_5$) that is needed in the inlet (5) of the compressor element (2) in order to obtain a realized pressure ratio ($p_r$) immediately after performing the first transitional step smaller than a preset maximum pressure ratio ($p_{max}$), for a pressure ($p_{10}$) at the outlet (10) that is equal to the set maximum operating pressure ($p_{15\ max}$) of the consumer network (15).

4. The method according to claim 3, wherein the extra gas flow ($\Delta Q$) is determined theoretically or experimentally in advance as a function of the set maximum operating pressure ($p_{15\ max}$) in the consumer network (15).

5. The method according to claim 4, wherein the extra gas flow ($\Delta Q$) is variable.

6. The method according to claim 4, wherein the extra gas flow ($\Delta Q$) has a fixed value.

7. The method according to claim 1, wherein a gas flow that is suctioned via the inlet (5) towards and into the compressor element (2) is controlled by closing the inlet valve (6) to a greater or smaller degree.

8. The method according to claim 7, wherein the inlet valve (6) has an end position corresponding with the aforementioned residual flow ($Q_D$), wherein in one of the successive discrete transitional steps, the inlet valve (6) is controlled toward a first position, in which the inlet valve (6) is not closed entirely into this end position in order to suction a gas flow towards and into the compressor element (2) that is larger than the residual flow ($Q_D$), and wherein the inlet valve (6) is closed further in at least one of the subsequent transitional steps into the end position.

9. The method according to claim 1, wherein a gas flow suctioned via the inlet (5) towards and into the compressor element (2) is controlled by connecting or not connecting the inlet (5) of the compressor element (2) via one or more additional sealable bypasses (39) with the valve inlet (7) of the inlet valve (6).

10. The method according to claim 9, wherein prior to the transition from the loaded state to the unloaded state, the inlet (5) of the compressor element (2) is connected via the one or more additional sealable bypasses (39) with the valve inlet (7) of the inlet valve (6), and wherein at least one of these additional sealable bypasses (39) is at least partially closed during at least one of the successive discrete transitional steps.

11. The method according to claim 1, wherein the residual flow ($Q_D$) corresponds with a minimum gas flow required to maintain a minimum equilibrium pressure ($p_{12u}$) in a pressure tank (12) connected to the pressure line (11).

12. The method according to claim 11, wherein a gas flow suctioned via the inlet (5) towards and into the compressor element (2) is controlled by connecting or not connecting the inlet (5) of the compressor element (2) via one or more additional sealable bypasses (39) with the pressure tank (12).

13. The method according to claim 12, wherein prior to the transition from the loaded state to the unloaded state, the inlet (5) of the compressor element (2) is connected via the one or more additional sealable bypasses (39) with the pressure tank (12), and wherein at least one of these additional sealable bypasses (39) is at least partially closed during at least one of the successive discrete transitional steps.

14. The method according to claim 11, wherein the method further comprises the following steps in order to determine a time for a subsequent transitional step:

determining a pressure ($p_{12}$) in the pressure tank (12);

for each transitional step, presetting an initialization pressure ($p_{12\ max}$) for the subsequent transitional step;

performing the subsequent transitional step when during the transition period, the pressure ($p_{12}$) in the pressure tank (12) is equal to or smaller than the preset initialization pressure ($p_{12\ max}$) for this sub sequent transitional step.

15. The method according to claim 14, wherein the preset initialization pressure ($p_{12\ max}$) is chosen such that immediately after performing the subsequent transitional step, a realized pressure ratio ($p_r$) over the compressor element (2) is smaller than a preset maximum pressure ratio ($p_{max}$).

16. The method according to claim 1, wherein the method further comprises the following steps in order to determine a time for a subsequent transitional step:

for each transitional step, presetting a time interval to the subsequent transitional step;

performing the subsequent transitional step after the end of the aforementioned time interval.

17. The method according to claim 1, wherein the partial closing of the inlet (5) during the transition period is performed in only two successive discrete transitional steps.

18. A compressor comprising a compressor element (2), the compressor element (2) being equipped with:

an inlet (5) and a controllable inlet valve (6) with a valve inlet (7), in which the inlet valve (6) is configured to be able to close the inlet (5), except for one or more calibrated openings (33, 34); and an outlet (10) with thereto connected a pressure line (11) which is connected to a downstream consumer network (15), in which the compressor further comprises a controllable blow-off valve (19) that is connected to the pressure line (11), in which the compressor further comprises a controller (35) for controlling the inlet valve (6) and the blow-off valve (19) during a transition from a loaded state of the compressor to an unloaded state, when an operating pressure ($p_{15}$) in the consumer network (15) reaches a set maximum operating pressure ($p_{15\ max}$), in which in the loaded state, the inlet valve (6) is entirely open and the blow-off valve (19) is closed, and in the unloaded state, the blow-off valve (19) is open and the inlet (5) of the compressor element (2) is partially closed by the inlet valve (6), such that after a transition period from the loaded state of the compressor to the unloaded state, in the unloaded state, a residual flow ($Q_D$) is suctioned via the inlet (5) towards and into the compressor element (2), wherein the compressor is equipped with means (38) to use the controller (35) to partially close the inlet (5) of the compressor element (2) during the transition period in successive discrete transitional steps.

19. The compressor according to claim 18, wherein the means (38) are configured to partially close the inlet (38) of the compressor element (2) in a first transitional step in such a manner that with respect to the aforementioned residual flow ($Q_D$), an extra flow ($\Delta Q$) is let through via the inlet (5), and wherein in any subsequent transitional step, the inlet (5) is closed further each time in order to suction increasingly smaller flows via the inlet (5) towards and into the compressor element (2).

20. The compressor according to claim 18, wherein the means (38) are configured to use the controller (35) to close the inlet valve (6) to a greater or smaller degree.

21. The compressor according to claim 18, wherein the aforementioned means (38) comprise one or more additional sealable bypasses (39) configured to form a connection between the inlet (5) of the compressor element (2) and the valve inlet (7) of the inlet valve (6), in which these additional sealable bypasses (39) are provided with a controllable seal (40).

22. The compressor according to claim 21, wherein the controller (35) is equipped with an algorithm to initially keep the inlet valve (6) closed during a certain delay period during a transition of the compressor from an unloaded state to a loaded state when a pressure ($p_{12}$) in the pressure tank (12) is smaller than a set minimum threshold value ($p_{12\ min}$), and to open it only afterward; and to open at least one of the additional sealable bypasses (39) during this delay period in order to allow the pressure in the pressure tank (12) to gradually increase, and to open the inlet valve (6) only at the moment that the pressure ($p_{12}$) in the pressure tank (12) has reached the set minimum threshold value ($p_{12\ min}$).

23. The compressor according to claim 18, wherein the compressor further comprises a pressure tank (12), which pressure tank (12) is connected to the pressure line (11), in which the means (38) are configured in such a manner that in the unloaded state, a residual flow ($Q_D$) is suctioned towards and into the compressor element (2) corresponding to a minimum gas flow required to maintain a minimum equilibrium pressure ($p_{12u}$) in the pressure tank (12).

24. The compressor according to claim 23, wherein the aforementioned means (38) comprise one or more additional sealable bypasses (39) configured to form a connection between the inlet (5) of the compressor element (2) and the pressure tank (12), in which these additional sealable bypasses (35) are provided with a seal (40) that is controllable by the controller (35).

25. The compressor according to claim 23, wherein the controller (35) is an electric or electronic controller, and wherein the inlet valve (6) and the blow-off valve (19) are pneumatically controlled by an electric valve connected to the pressure tank (12).

26. The compressor according to claim 23, wherein a pressure sensor (37) is provided to measure a pressure ($p_{12}$) in the pressure tank (12), and wherein the controller (35) is such that during the transition period, a transitional step is performed when a measured pressure in the pressure tank (12) is equal or smaller than a preset initialization pressure ($p_{12\ max}$).

27. The compressor according to claim 18, wherein the controller (35) is equipped with a timer with set time intervals between the successive discrete transitional steps in order to perform these successive discrete transitional steps.

28. The compressor according to claim 18, wherein the compressor has a fixed rotational speed.

29. The compressor according to claim 18, wherein the compressor is equipped with a drive for the compressor element (2), in which no elastic coupling is provided between the compressor element (2) and the drive.

* * * * *